US012151134B2

(12) United States Patent
Park et al.

(10) Patent No.: US 12,151,134 B2
(45) Date of Patent: Nov. 26, 2024

(54) WEARABLE UPPER BODY EXERCISE APPARATUS

(71) Applicant: SAMSUNG ELECTRONICS CO., LTD., Suwon-si (KR)

(72) Inventors: Junghoon Park, Suwon-si (KR); Jaehong Kim, Suwon-si (KR); Minhyung Lee, Suwon-si (KR); Seungyong Hyung, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 70 days.

(21) Appl. No.: 18/187,987

(22) Filed: Mar. 22, 2023

(65) Prior Publication Data

US 2023/0271047 A1 Aug. 31, 2023

Related U.S. Application Data

(63) Continuation of application No. PCT/KR2023/002545, filed on Feb. 22, 2023.

(30) Foreign Application Priority Data

Feb. 25, 2022 (KR) ..... 10-2022-0025196

(51) Int. Cl.
*A63B 21/00* (2006.01)

(52) U.S. Cl.
CPC .... *A63B 21/00043* (2013.01); *A63B 21/4001* (2015.10); *A63B 21/4025* (2015.10); *A63B 21/4043* (2015.10)

(58) Field of Classification Search
CPC ..... A63B 21/00043; A63B 21/4001; A63B 21/4025; A63B 21/4043; A63B 21/00069;
(Continued)

(56) References Cited

U.S. PATENT DOCUMENTS 4,993,705 A * 2/1991 Tolle ..... A63B 21/4043 482/139
5,203,754 A * 4/1993 Maclean ..... A63B 21/4015 482/121
(Continued)

FOREIGN PATENT DOCUMENTS

KR 10-1516758 B1 4/2015
KR 10-2018-0076694 A 7/2018
(Continued)

OTHER PUBLICATIONS

International Search Report dated Jun. 2, 2023 for PCT application No. PCT/KR2023/002545.

*Primary Examiner* — Andrew S Lo
(74) *Attorney, Agent, or Firm* — Nixon & Vanderhye P.C.

(57) ABSTRACT

A wearable exercise apparatus may include one or more of: a torso support including an abdominal frame, a chest frame, a shoulder frame, a back frame, an arm frame, a first guide, a wrist frame, a second guide, a glove, a dial rotatably connected to the chest frame, a string connected to the dial, at least partially wound around the dial, and passing through an inner space of each of the torso support and the first guide, and an elastic band having one end connected to the string and the other end connected to the wrist frame or the glove, passing through an inner space of each of the arm frame and the second guide, and extending or contracting by a tension of the string.

15 Claims, 7 Drawing Sheets

(58) Field of Classification Search
CPC ..... A63B 21/0557; A63B 21/4005; A63B 21/4017; A63B 23/03541; A63B 23/1209; A63B 21/4019; A63B 21/4021; A63B 2071/0655; A63B 2220/24; A63B 2220/40; A63B 2220/51; A63B 2220/803; A63B 2220/833; A63B 21/0552
See application file for complete search history.

(56) References Cited

U.S. PATENT DOCUMENTS 5,306,222 A * 4/1994 Wilkinson ..... A63B 23/03508 482/121
5,518,480 A * 5/1996 Frappier ..... A63B 21/4007 482/129
5,683,336 A * 11/1997 Pape ..... A63B 23/03541 482/121
5,792,034 A * 8/1998 Kozlovsky ..... A63B 21/4009 482/124
5,820,534 A * 10/1998 Vadher ..... A63B 21/4005 482/125
5,867,826 A * 2/1999 Wilkinson ..... A63B 21/00069 2/69
5,993,362 A * 11/1999 Ghobadi ..... A63B 21/4015 482/121
6,099,446 A * 8/2000 Johnson ..... A63B 21/4005 482/124
7,608,026 B1 * 10/2009 Nicassio ..... A63B 21/4015 482/121
7,628,742 B2 * 12/2009 Weaver ..... A63B 21/4025 482/125
7,744,511 B2 * 6/2010 Grigoriev ..... A63B 21/4011 482/121
7,850,583 B2 * 12/2010 Smith ..... A63B 21/4001 482/124
10,049,595 B1 * 8/2018 Chuang ..... G01P 13/00
2011/0209264 A1 * 9/2011 Williams ..... A41D 13/0015 2/69
2013/0333097 A1 * 12/2013 Cranke ..... A63B 21/0557 2/300
2015/0065317 A1 * 3/2015 Washington ..... A63B 23/14 482/124
2018/0021624 A1 * 1/2018 Cordero ..... A63B 21/154 601/48
2024/0149102 A1 * 5/2024 Park ..... A63B 24/0062

FOREIGN PATENT DOCUMENTS

KR 10-2020-0059811 A 5/2020
KR 10-2021-0072454 A 6/2021

* cited by examiner

WEARABLE UPPER BODY EXERCISE APPARATUS

CROSS-REFERENCE TO RELATED APPLICATIONS

This application is a continuation application of International Application PCT/KR2023/002545 designating the United States, filed on Feb. 22, 2023, in the Korean Intellectual Property Receiving Office, and claiming priority to Korean Patent Application No. 10-2022-0025196 filed on Feb. 25, 2022, in the Korean Intellectual Property Office, the disclosures of which are all hereby incorporated by reference herein in their entireties.

BACKGROUND

1. Field

One or more example embodiments relate to a wearable upper body exercise apparatus.

2. Description of Related Art

The exercise apparatus refers to an apparatus or a device that helps a user to exercise. With the recent intensification of an aging society, a growing number of people experience inconvenience in exercising or have difficulty with normal exercising due to malfunctioning joints, and there is increasing interest in exercising apparatuses.

The above description is information the inventor(s) acquired during the course of conceiving the present disclosure, or already possessed at the time, and is not necessarily art publicly known before the present application was filed.

SUMMARY

According to example embodiments, a wearable upper body exercise apparatus may include a torso support including an abdominal frame, a chest frame connected, directly or indirectly, to the abdominal frame, a shoulder frame connected, directly or indirectly, to the chest frame, and a back frame connected, directly or indirectly, to the shoulder frame and, provided on an opposite side of the abdominal frame with respect to a user torso, an arm frame configured to support the user arm, a first guide connecting, directly or indirectly, the torso support and the arm frame and having an inner space communicating with an inner space of the torso support and the arm frame, a wrist frame configured to support the user wrist, a second guide connecting, directly or indirectly, the arm frame and the wrist frame and having an inner space communicating with an inner space of the arm frame and the wrist frame, a glove connected, directly or indirectly, to the wrist frame and worn on the user hand, a dial rotatably connected, directly or indirectly, to the chest frame, a string connected, directly or indirectly, to the dial, at least partially wound around the dial, and passing through an inner space of each of the torso support and the first guide, and an elastic band having one end connected, directly or indirectly, to the string and the other end connected, directly or indirectly, to the wrist frame or the glove, passing through an inner space of each of the arm frame and the second guide, and extending or contracting by a tension of the string.

The elastic band, in a state in which a position of the wrist frame is fixed, may be configured to extend or contract based on a degree to which the string is wound around the dial.

The elastic band, in a state in which a degree to which the string is wound around the dial is fixed, may be configured to extend or contract based on a movement of the wrist frame.

The elastic band may include a material having greater elasticity than the string.

The elastic band may include a rubber material.

At least one frame of the chest frame and the shoulder frame may include a plurality of frame bodies, a pair of leather seats covering both sides of the plurality of frame bodies, and/or a tube positioned between the plurality of frame bodies, positioned between the pair of leather seats, and accommodating the string.

Each inner space of the first guide and the second guide may be communicated with each other.

The apparatus may include a connection part connected, directly or indirectly, to the arm frame, including a more rigid material than the arm frame, and having an inner space accommodating at least one of the string and the elastic band.

At least a portion of the elastic band may be enterable inside of the first guide.

The first guide may be connected, directly or indirectly, to the shoulder frame, and a point in which the first guide and the shoulder frame are connected may be provided on an opposite side of the dial with respect to the user torso.

The first guide may be connected, directly or indirectly, to the chest frame.

The torso support may include a pair of elastic frames connecting, directly or indirectly, the abdominal frame and the back frame.

The first guide may be connected, directly or indirectly, to the elastic frame.

The apparatus may include a motion sensor disposed on at least one of the torso support, the arm frame, and the wrist frame.

The apparatus may include a vibrator disposed on at least one of the torso support, the arm frame, and the wrist frame.

BRIEF DESCRIPTION OF THE DRAWINGS

These and/or other aspects, features, and advantages will become apparent and more readily appreciated from the following description of example embodiments, taken in conjunction with the accompanying drawings, in which like reference numbers may indicate like parts throughout the several views, of which.

DETAILED DESCRIPTION

Figure 1:
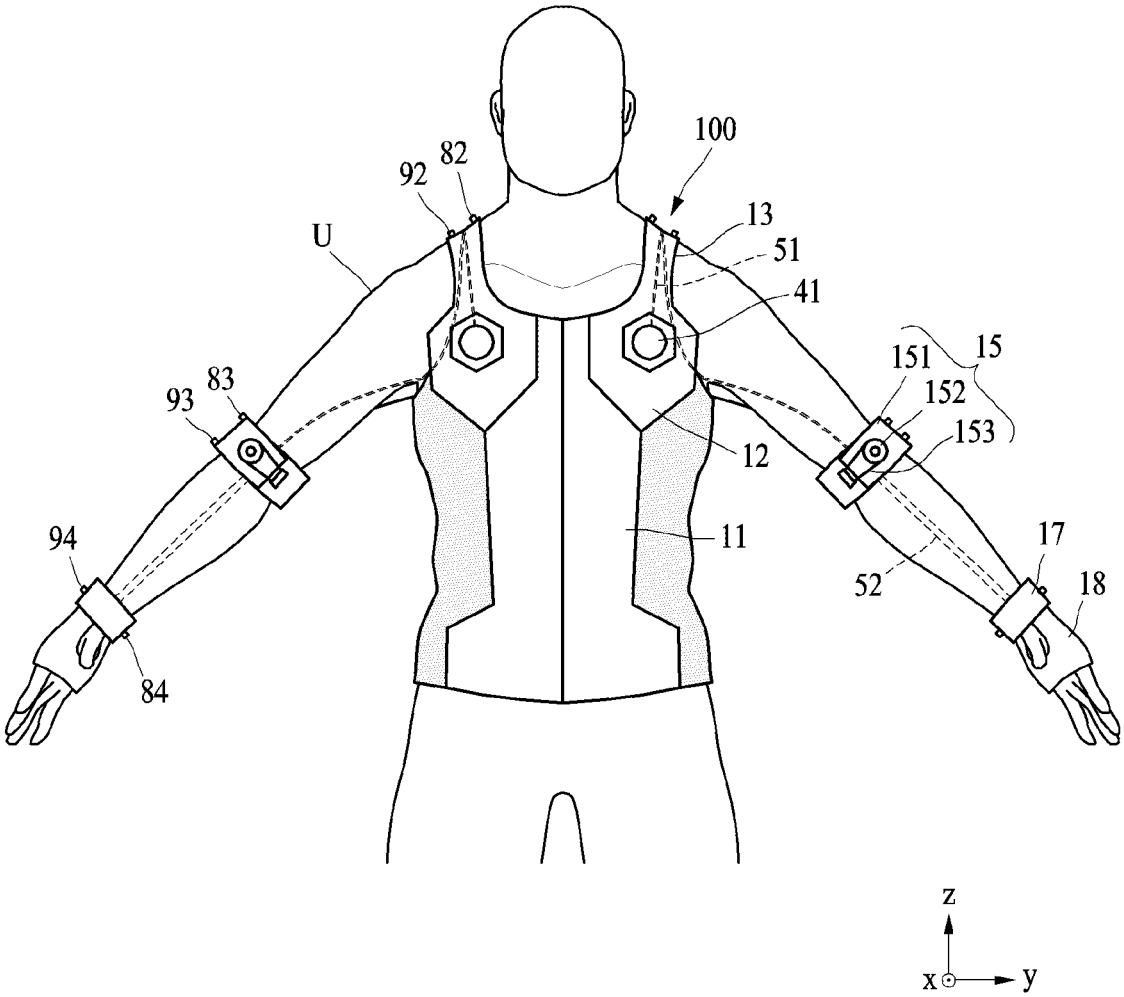
FIG. 1 is a front view illustrating a wearable upper body exercise apparatus according to an example embodiment.

The following detailed structural or functional description is provided as an example only and various alterations and modifications may be made to the examples. Here, examples are not construed as limited to the disclosure and should be understood to include all changes, equivalents, and replacements within the idea and the technical scope of the disclosure.

Terms, such as first, second, and the like, may be used herein to describe various components. Each of these terminologies is not used to define an essence, order or sequence of a corresponding component but used merely to distinguish the corresponding component from other component(s). For example, a first component may be referred to as a second component, and similarly the second component may also be referred to as the first component.

It should be noted that if it is described that one component is "connected", "coupled", or "joined" to another component, at least a third component may be "connected", "coupled", and "joined" between the first and second components, although the first component may be directly connected, coupled, or joined to the second component.

The singular forms "a", "an", and "the" are intended to include the plural forms as well, unless the context clearly indicates otherwise. It will be further understood that the terms "comprises/comprising" and/or "includes/including" when used herein, specify the presence of stated features, integers, steps, operations, elements, and/or components, but do not preclude the presence or addition of one or more other features, integers, steps, operations, elements, components and/or groups thereof.

The same name may be used to describe an element included in the example embodiments described above and an element having a common function. Unless otherwise mentioned, the descriptions on the example embodiments may be applicable to the following example embodiments and thus, duplicated descriptions will be omitted for conciseness.

Unless otherwise defined, all terms, including technical and scientific terms, used herein have the same meaning as commonly understood by one of ordinary skill in the art to which this disclosure pertains. Terms, such as those defined in commonly used dictionaries, are to be interpreted as having a meaning that is consistent with their meaning in the context of the relevant art, and are not to be interpreted in an idealized or overly formal sense unless expressly so defined herein.

Hereinafter, examples will be described in detail with reference to the accompanying drawings. When describing the example embodiments with reference to the accompanying drawings, like reference numerals refer to like elements and a repeated description related thereto will be omitted.

Figure 2:
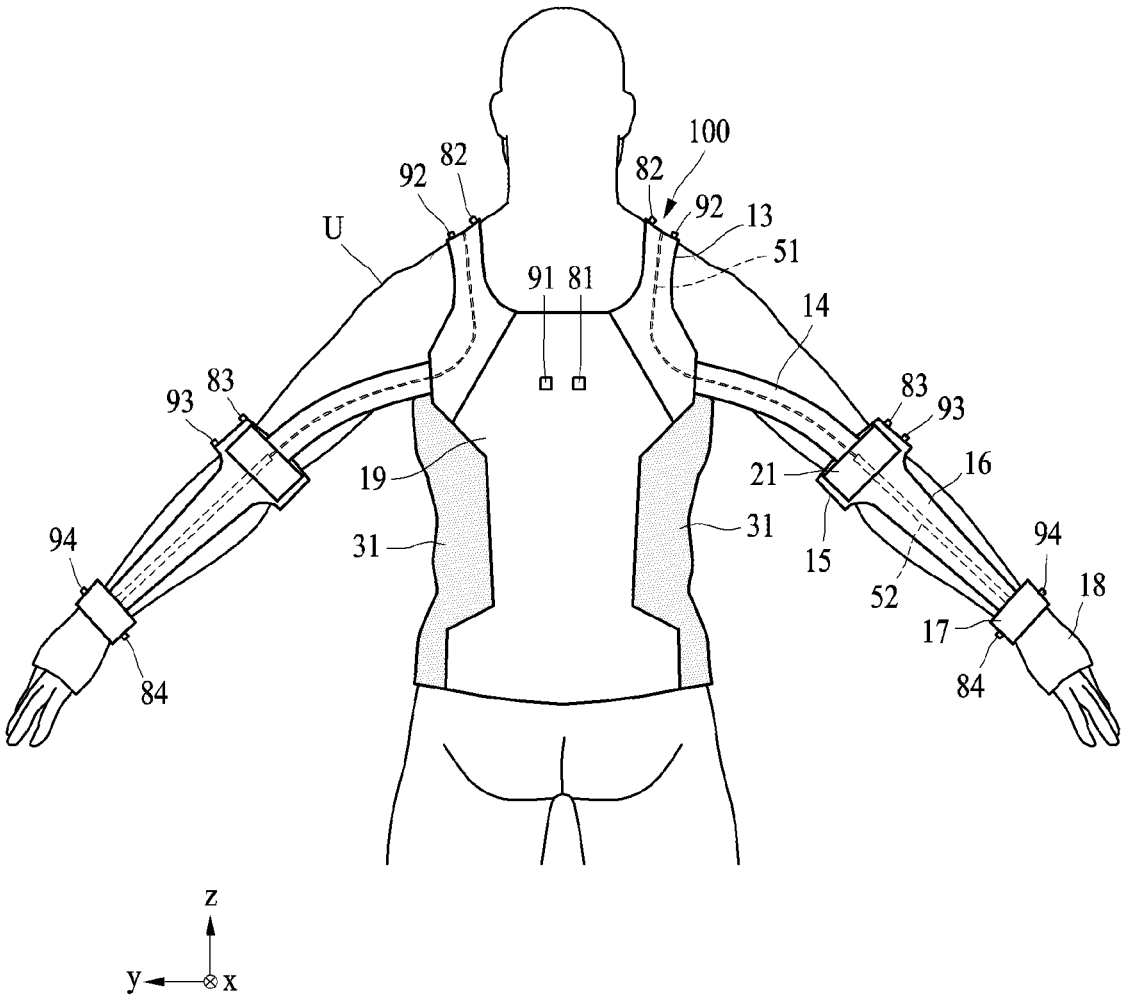
FIG. 2 is a rear view illustrating a wearable upper body exercise apparatus according to an example embodiment.

FIG. 1 is a front view illustrating a wearable upper body exercise apparatus according to an example embodiment, and FIG. 2 is a rear view illustrating a wearable upper body exercise apparatus according to an example embodiment.

Referring to FIG. 1 and FIG. 2, a wearable upper body exercise apparatus 100 (hereinafter referred to as an exercise apparatus) may assist an exercising of a user U. The user may perform various exercises while wearing the exercise apparatus 100 on the upper body. The user may perform the exercise after properly adjusting the load. For example, the user may perform a shoulder exercise or a chest exercise while wearing the exercise apparatus 100. The user may perform a shoulder exercise by moving the arm up and down. The user may perform a chest exercise by moving the arm forward in a state in which the arm is spread left and right. The user may perform a chest exercise through a push-up motion in a standing state. However, motions and exercises that the user may perform while wearing the exercise apparatus 100 are not limited thereto.

The exercise apparatus may include a torso support, a first guide 14, an arm frame 15, a second guide 16, a wrist frame 17, a glove 18, a connection part/connector 21, an elastic frame 31, a dial 41, a string 51, an elastic band 52, motion sensors 81, 82, 83 and 84, and vibrators 91, 92, 93 and 94.

The torso support may be worn on the user torso. The torso support may include an abdominal frame 11, a chest frame 12, a shoulder frame 13, a back frame 19, and the elastic frame 31.

The abdominal frame 11 may cover at least part of the user abdomen. The abdominal frame 11 may be provided as a pair on both sides with respect to the center of the user torso. For example, the abdominal frame 11 may include a zipper (not shown) for attaching and detaching. For example, the abdominal frame 11 may include a Velcro provided to adjust the width according to the size of the user torso.

Each chest frame 12 may cover at least part of the user chest. The chest frame 12 may be connected to the abdominal frame 11 of the user. The chest frame 12 may be integrally formed with the abdominal frame 11 or may be provided as a separate frame and connected to the abdominal frame 11 through a separate connecting member(s). The chest frame 12 may support the dial 41. The chest frame 12 may have a space for guiding the string 51 therein.

Each shoulder frame 13 may cover at least part of the user shoulder(s). The shoulder frame 13 may be connected, directly or indirectly, to the chest frame 12 of the user. The shoulder frame 13 may be integrally formed with the chest frame 12 or may be provided as a separate frame and connected to the chest frame 12 through a separate connecting member(s). The shoulder frame 13 may include a space for guiding the string 51 therein.

The back frame 19 may cover at least part of the user back. The back frame 19 may be connected to the shoulder frame. The back frame 19 may be integrally formed with the shoulder frame 13 or may be provided as a separate frame and connected to the shoulder frame 13 through a separate connecting member(s). The back frame 19 may be provided on the opposite side of the abdominal frame 11 with respect to the user torso.

Each elastic frame 31 may connect the abdominal frame 11 and the back frame 19. Each elastic frame 31 may be of or include a material having greater elasticity than the abdominal frame 11 and the back frame 19. Each elastic frame 31 may assist the torso support to be in close contact with the user torso.

Each arm frame 15 may support the corresponding user arm. For example, the arm frame 15 may be wound around the upper arm and/or lower arm of the user. The arm frame 15 may include an arm frame body 151, an arm frame protrusion 152, and a connecting member/connector 153. The user may detach the arm frame 15 by attaching or detaching the connecting member 153 to the arm frame protrusion 152.

Each first guide 14 may connect the torso support and the corresponding arm frame 15. For example, the first guide 14 may be connected to the shoulder frame 13 of the torso support. The position in which the first guide 14 is connected to the torso support is not limited thereto. The first guide 14 may have an inner space communicating with an inner space of the shoulder frame 13 and the arm frame 15. For example, the first guide 14 may be provided along the user upper arm.

Each wrist frame 17 may support the corresponding user wrist.

Each second guide 16 may connect, directly or indirectly, the corresponding arm frame 15 and the corresponding wrist frame 17. Each second guide 16 may have an inner space communicating with an inner space of the arm frame 15 and the wrist frame 17.

Each glove 18 may be connected, directly or indirectly, to the corresponding wrist frame 17 and may be worn on the corresponding user hand.

Each connection part 21 may be connected, directly or indirectly, to the corresponding arm frame 15 and may include a more rigid material than the arm frame 15. The connection part 21 may improve the durability of the arm frame 15. The connection part 21 may have an inner space for accommodating at least one of the string 51 and the elastic band 52.

Each dial 41 may be disposed on, directly or indirectly, the chest frame 12. The dial 41 may be rotatably connected to the chest frame. At least a portion of the string 51 may be wound around the dial 41. The user may adjust the length of the string 51 wound around the dial 41 by winding or unwinding the dial 41. For example, the user may increase the length of the string 51 wound around the dial 41 by rotating the dial 41 in a clockwise direction and may reduce the length of the string 51 wound around the dial 41 by rotating the dial 41 in a counterclockwise direction.

Each string 51 may have one end connected to the corresponding dial 41. At least a portion of each string 51 may be wound around the dial 41 and may pass through an inner space of each of the torso support and the corresponding first guide 14.

Each elastic band 52 may have one end connected, directly or indirectly, to the string 51 and the other end connected, directly or indirectly, to the wrist frame 17 and/or the glove 18. Each elastic band 52 may pass through an inner space of each of the corresponding arm frame 15 and the corresponding second guide 16 and may be extended or contracted by the tension of the string 51. When the extended length of the elastic band 52 increases, the load applied to the user torso increases so that the user may perform the exercise with relatively strong intensity. When the extended length of the elastic band 52 is reduced, the load applied to the user torso is reduced, so that the user may perform the exercise with relatively weak intensity.

Each elastic band 52 may include a material having greater elasticity than the string 51. For example, the string 51 may include a non-stretchable material and the elastic band 52 may include a rubber material. The elastic band 52 may have a band shape, not a shape having a relatively large volume like an elastic spring. According to such a structure, the elastic band 52 may be easily disposed inside of a relatively thin structure.

The string 51 and the elastic band 52 may not be exposed to the outside in certain example embodiments. The string 51 and the elastic band 52 may be provided at least one or more inner space of the torso support, the first guide 14, the connection part 21, the arm frame 15, the second guide 16, and the wrist frame 17. According to such a structure, the exercise apparatus 100 may have a compact structure.

Motion sensors 81, 82, 83 and 84 may detect a motion of a user wearing the exercise apparatus 100. The motion sensors 81 to 84 may be disposed on, directly or indirectly, at least one of the torso support, the arm frame 15, and the wrist frame 17. For example, the motion sensor(s) may include a first motion sensor 81 disposed on the back frame 19, a second motion sensor 82 disposed on the shoulder frame 13, a third motion sensor 83 disposed on the arm frame 15, and a fourth motion sensor disposed on the wrist frame 17. The motion sensors 81 to 84 may include an accelerometer, a gyro sensor, and/or an inertial sensor, for example. The information detected in the motion sensors 81 to 84 may be transmitted to a controller (not shown) comprising processing circuitry. The controller, including at least one processor, may be provided in the exercise apparatus 100 and/or may be provided in an external separate electronic apparatus.

The vibrators 91, 92, 93 and 94 may provide a feedback signal to the user based on the information sensed by the corresponding motion sensors 81 to 84. For example, the vibrators 91 to 94 may generate vibrations. For example, when there is a portion requiring posture correction, the controller may control the vibrator among the vibrators 91 to 94 provided in the portion requiring the posture correction to generate vibration. The vibrators 91 to 94 may be disposed on, directly or indirectly, at least one of the torso support, the arm frame 15, and the wrist frame 17. For example, the vibrators 91 to 94 may include a first vibrator 91 disposed on the back frame, a second vibrator 92 disposed on the shoulder frame 13, a third vibrator 93 disposed on the arm frame 15, and a fourth vibrator 94 disposed on the wrist frame 17.

Figure 3:
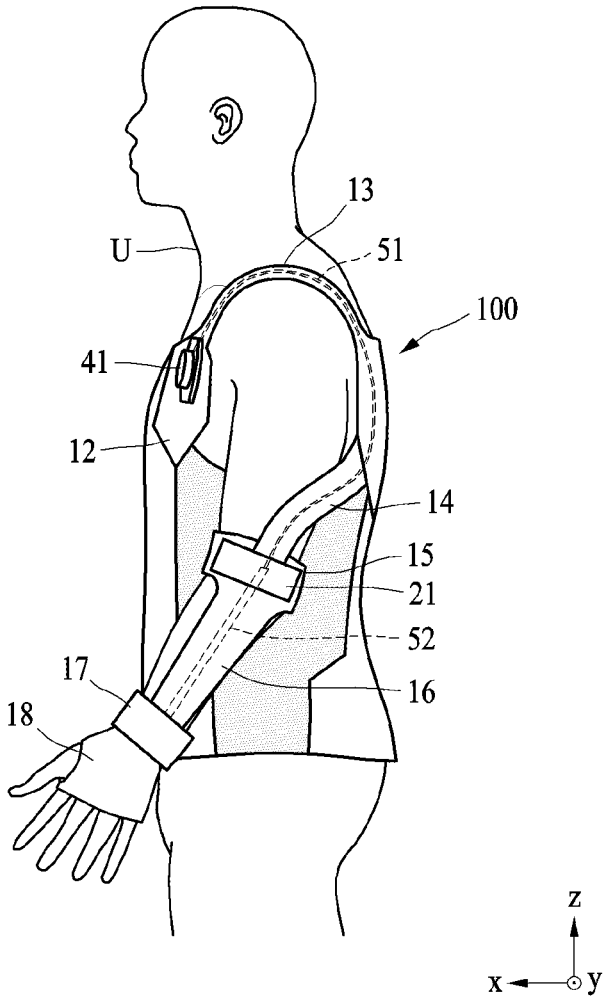
FIG. 3 is a side view illustrating a wearable upper body exercise apparatus according to an example embodiment.
Figure 4:
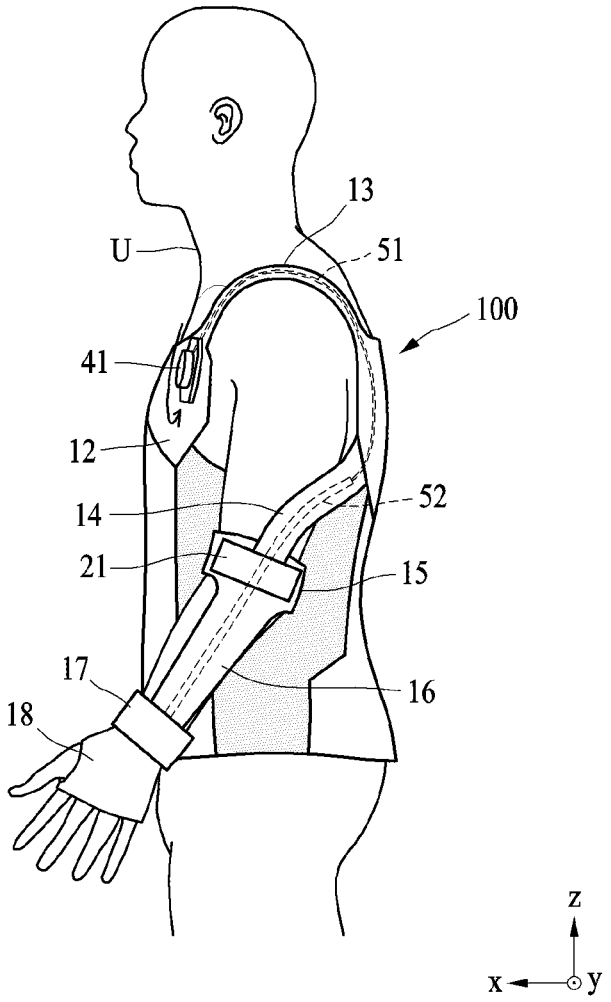
FIG. 4 is a side view illustrating an extended elastic band in a wearable upper body exercise apparatus of FIG. 3.
Figure 5:
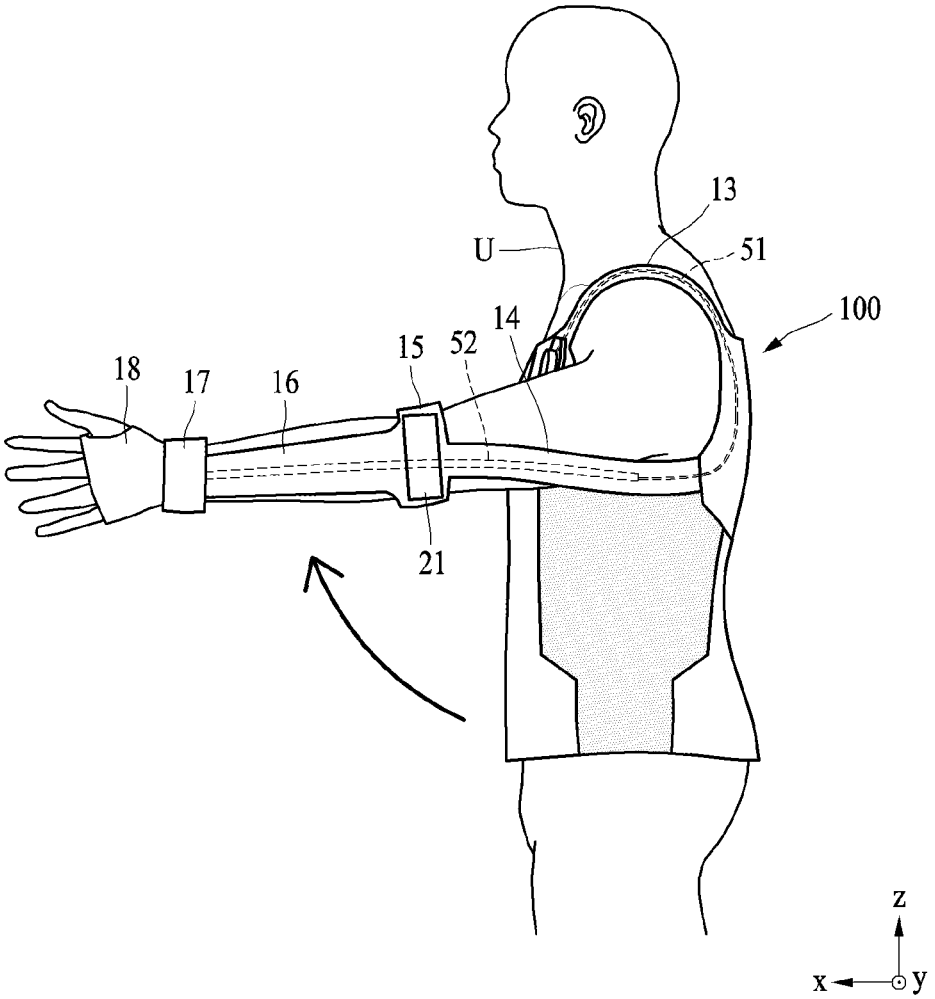
FIG. 5 is a side view illustrating a state in which a user wearing a wearable upper body exercise apparatus of FIG. 4 raises an arm.

FIG. 3 is a side view illustrating a wearable upper body exercise apparatus according to an example embodiment, FIG. 4 is a side view illustrating an extended elastic band in a wearable upper body exercise apparatus of FIG. 3, and FIG. 5 is a side view illustrating a state in which a user wearing a wearable upper body exercise apparatus of FIG. 4 raises an arm.

Referring to FIG. 3 to FIG. 5, the exercise apparatus 100 may be worn on the upper body of the user U. The exercise apparatus 100 may include the torso supports 12 and 13, the first guide 14, the arm frame 15, the second guide 16, the wrist frame 17, the glove 18, and the connection part 21, the dial 41, the string 51 and the elastic band 52. As shown in the figures, a pair of each of components 14, 15, 16, 17, 18, 21, 41, 51, and 52 may be provided, one for each side of the user's body—this applies to other embodiments and other components herein as well as indicated in the figures. Operation of the components for one side of the user's body is similar to operation of the components for the other side of the user's body.

In a state in which the position of the wrist frame 17 is fixed, the elastic band 52 may be extended or contracted based on the degree to which the string 51 is wound around the dial 41. Herein, a decrease of the extended length of the elastic band 52 is also referred to as "contraction." The user may adjust the length of the elastic band 52 by adjusting the dial 41. The exercise intensity may be set by adjusting the length of the elastic band 52.

Each inner space of the first guide 14 and the second guide 16 may be communicated with each other.

The elastic band 52 may be provided in the inner space of the second guide 16 in the initial state but may not be provided in the inner space of the first guide 14. When the tension of the string 51 increases and the elastic band 52 is extended, at least a portion of the elastic band 52 may enter the inside the first guide 14.

In a state in which the degree to which the string 51 is wound around the dial 41 is fixed, the elastic band 52 may be extended or contracted based on the movement of the wrist frame 17. For example, the user may perform various exercises by moving the upper body in various postures.

The first guide 14 may be connected to the chest frame 12. The first guide 14 may be connected to the shoulder frame 13, and a point in which the first guide 14 and the shoulder frame 13 are connected may be provided on the opposite side of the dial 41 with respect to the user torso.

Figure 6:
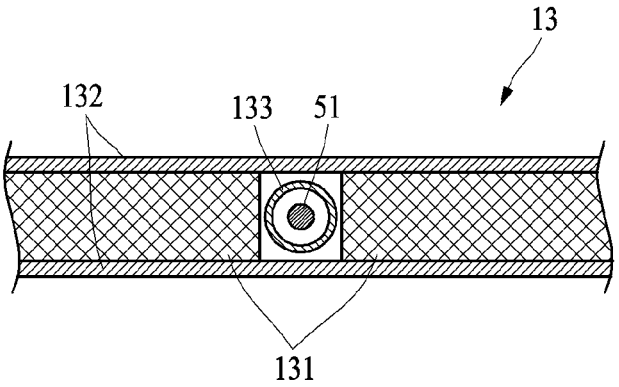
FIG. 6 is a cross-sectional view illustrating a shoulder frame according to an example embodiment.

FIG. 6 is a cross-sectional view illustrating a shoulder frame according to an example embodiment.

Referring to FIG. 6, at least one of the chest frame 12 and the shoulder frame 13 may include a configuration for preventing or reducing unintentional movement of the string 51. Hereinafter, the description will be made based on the shoulder frame 13 but it may also be applied to the chest frame 12.

The shoulder frame 13 may include a plurality of frame bodies 131, a pair of leather seats 132 covering both sides of the plurality of frame bodies 131, and a tube 133 accommodating the strings 51. The tube 133 may include a material having relatively low friction. The tube 133 may be positioned between at least the plurality of frame bodies 131 and positioned between at least the pair of leather seats 132.

Figure 7:
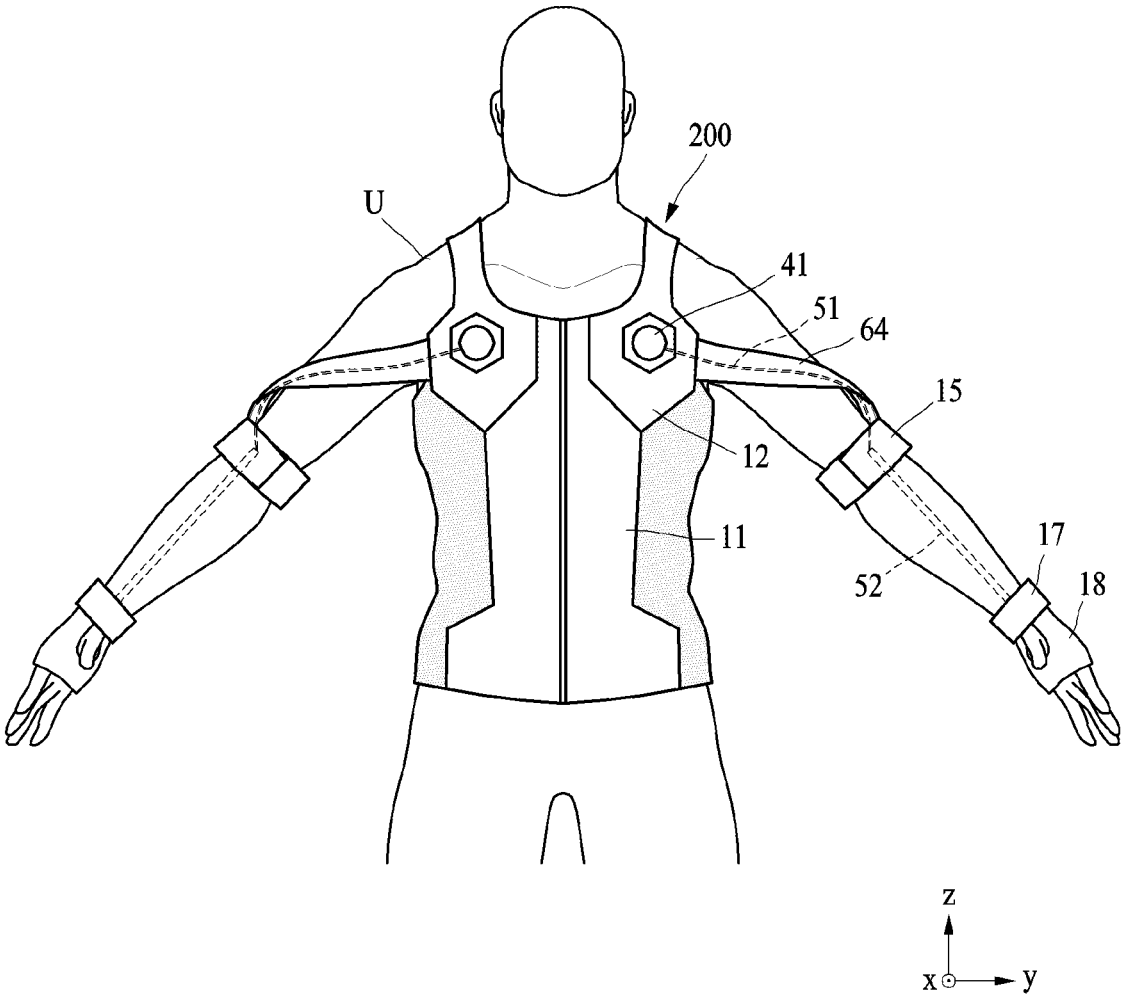
FIG. 7 is a front view illustrating a wearable upper body exercise apparatus according to an example embodiment.

FIG. 7 is a front view illustrating a wearable upper body exercise apparatus according to an example embodiment.

Referring to FIG. 7, the exercise apparatus 200 (similar to 100 discussed above) may be worn on the upper body of the user U. The exercise apparatus 200 may include the torso supports 11 and 12, the first guide 64, the arm frame 15, the second guide, the wrist frame 17, the glove 18, the dial 41, the string 51, and the elastic band 52. The first guide 64 may have one end connected to the chest frame 12 and the other end connected to the arm frame 15.

The user may perform various exercises while wearing the exercise apparatus 100/200 on the upper body. The user may perform the exercise after properly adjusting the load. For example, the user may perform a triceps exercise or a back exercise while wearing the exercise apparatus 100/200. The user may perform the triceps exercise by curling and extending the arm. The user may perform the back exercise by moving the elbow backward in a state in which the arm is stretched forward. The motions and exercises that the user may perform while wearing the exercise apparatus 100/200 are not limited thereto.

Each embodiment herein may be used in combination with any other embodiment(s) described herein.

Figure 8:
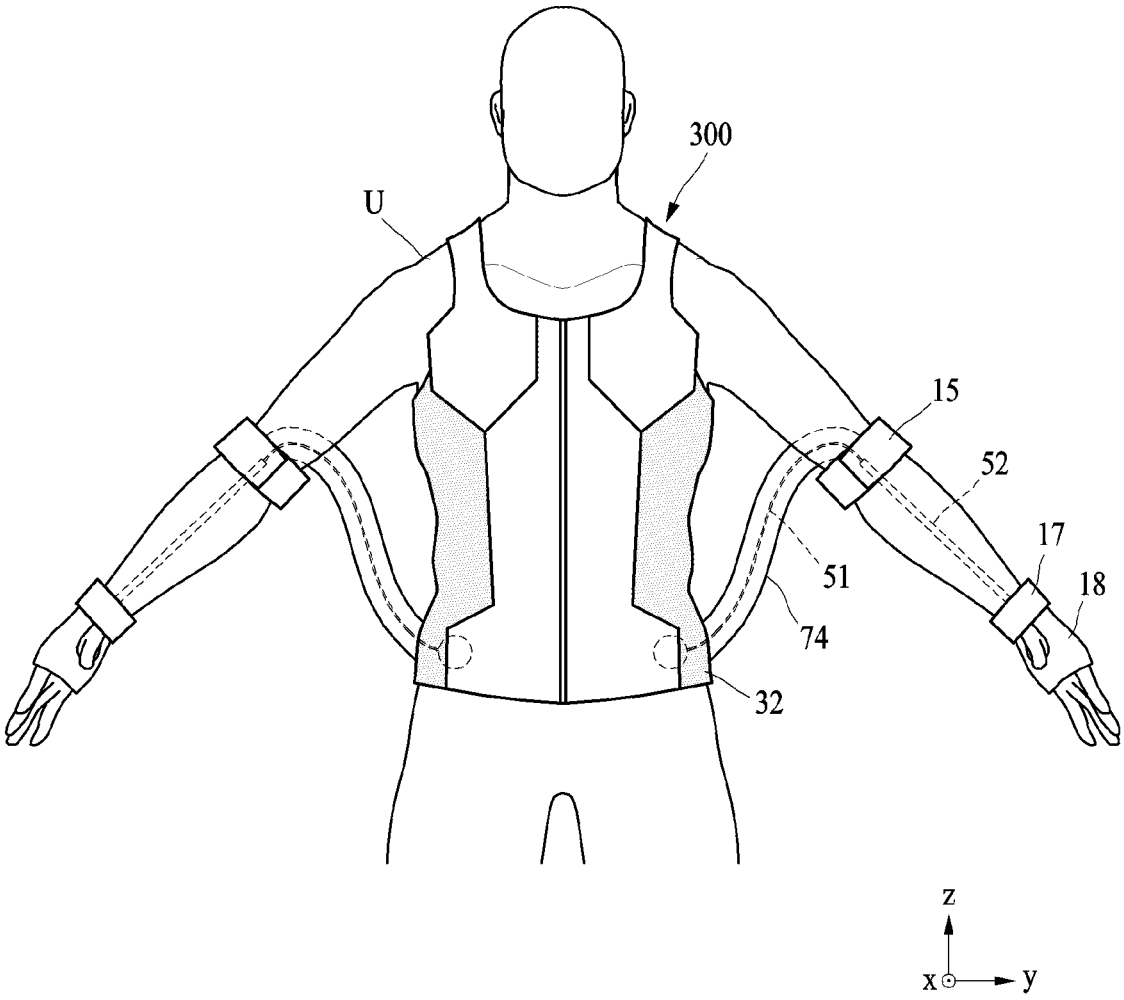
FIG. 8 is a front view illustrating a wearable upper body exercise apparatus according to an example embodiment.

FIG. 8 is a front view illustrating a wearable upper body exercise apparatus according to an example embodiment.

Referring to FIG. 8, the exercise apparatus 300 (similar to 100 and 200 above) may be worn on the upper body of the user U. The exercise apparatus 300 may include the torso support 32, the first guide 74, the arm frame 15, the second guide, the wrist frame 17, the glove 18, the string 51, and the elastic band 52. The first guide 74 may have one end connected to the elastic frame 31 and the other end connected to the arm frame 15.

The user may perform various exercises while wearing the exercise apparatus 100/200/300 on the upper body. The user may perform the exercise after properly adjusting the load. For example, the user may perform a biceps exercise or an abdominal exercise while wearing the exercise apparatus 100/200/300. The user may perform the biceps exercise by extending and curling the arm. The user may perform the abdominal exercise by moving the arm forward and backward while kneeling in a tabletop position. The motions and exercises that the user may perform while wearing the exercise apparatus 100/200/300 are not limited thereto.

As described above, although the examples have been described with reference to the limited drawings, a person skilled in the art may apply various technical modifications and variations based thereon. For example, suitable results may be achieved if the described techniques are performed in a different order and/or if components in a described system, architecture, device, or circuit are combined in a different manner and/or replaced or supplemented by other components or their equivalents.

Accordingly, other implementations are within the scope of the following claims.

What is claimed is:

1. A wearable upper body exercise apparatus, the wearable upper body exercise apparatus comprising:

a torso support comprising an abdominal frame, a chest frame connected to the abdominal frame, a shoulder frame connected to the chest frame, and a back frame connected to the shoulder frame and configured to be at least partially provided on an opposite side of the abdominal frame with respect a user torso;

an arm frame configured to support a user arm;

a first guide connecting the torso support and the arm frame and comprising an inner space for communicating with at least an inner space of the torso support and an inner space of the arm frame;

a wrist frame configured to support a user wrist;

a second guide connecting the arm frame and the wrist frame and comprising an inner space for communicating with at least an inner space of the arm frame and an inner space of the wrist frame;

a glove connected to the wrist frame and configured to be worn on a user hand;

a rotatable dial supported by the chest frame;

a string connected to the dial, at least partially wound around the dial, and passing through the inner space of each of the torso support and the inner space of the first guide; and an elastic band, a first end of the elastic band connected to at least the string and a second end of the elastic band connected to at least the wrist frame and/or the glove, the elastic band passing at least partially through the inner space of the arm frame and the inner space of the second guide, and configured for extending or contracting based on tension from the string.

2. The apparatus of claim 1, wherein the elastic band, in a state in which a position of the wrist frame is fixed, is configured to extend or contract based on a degree to which the string is wound around the dial.

3. The apparatus of claim 1, wherein the elastic band, in a state in which a degree to which the string is wound around the dial is fixed, is configured to extend or contract based on a movement of the wrist frame.

4. The apparatus of claim 1, wherein the elastic band comprises an elastic material having greater elasticity than the string.

5. The apparatus of claim 4, wherein the elastic band comprises a rubber inclusive material.

6. The apparatus of claim 1, wherein at least one frame of the chest frame and the shoulder frame comprises:

a plurality of frame bodies;

a pair of leather seats covering both sides of the plurality of frame bodies; and a tube positioned between at least the plurality of frame bodies, positioned between at least the pair of leather seats, and accommodating the string.

7. The apparatus of claim 1, wherein each inner space of the first guide and the second guide is communicated with each other.

8. The apparatus of claim 7, further comprising:

a connector connected to the arm frame, comprising a more rigid material than the arm frame, and comprising an inner space accommodating at least one of the string and the elastic band.

9. The apparatus of claim 1, wherein at least a portion of the elastic band is configured to enter inside of the first guide.

10. The apparatus of claim 1, wherein the first guide is connected to the shoulder frame, wherein a location at which the first guide and the shoulder frame are connected is provided on an opposite side of the dial with respect to the user torso.

11. The apparatus of claim 1, wherein the first guide is connected to the chest frame.

12. The apparatus of claim 1, wherein the torso support comprises a pair of elastic frames connecting the abdominal frame and the back frame.

13. The apparatus of claim 12, wherein the first guide is connected to at least one of the pair of elastic frames.

14. The apparatus of claim 1, further comprising:

a motion sensor disposed on at least one of the torso support, the arm frame, and the wrist frame.

15. The apparatus of claim 14, further comprising:

a vibrator disposed on at least one of the torso support, the arm frame, and the wrist frame.

* * * * *